US010121627B1

(12) United States Patent
Wynohrad

(10) Patent No.: US 10,121,627 B1
(45) Date of Patent: Nov. 6, 2018

(54) ION PUMP NOBLE GAS STABILITY USING SMALL GRAIN SIZED CATHODE MATERIAL

(71) Applicant: Edwards Vacuum LLC, Sanborn, NY (US)

(72) Inventor: Anthony Wynohrad, Osage, IA (US)

(73) Assignee: Edwards Vacuum LLC, Sanborn, NY (US)

( * ) Notice: Subject to any disclaimer, the term of this patent is extended or adjusted under 35 U.S.C. 154(b) by 0 days.

(21) Appl. No.: 15/794,023

(22) Filed: Oct. 26, 2017

(51) Int. Cl.
*H01J 1/146* (2006.01)
*H01J 9/04* (2006.01)
*H01J 9/18* (2006.01)

(52) U.S. Cl.
CPC ..... *H01J 1/146* (2013.01); *H01J 9/042* (2013.01); *H01J 9/18* (2013.01)

(58) Field of Classification Search
CPC ..... H01J 1/146; H01J 9/18; H01J 9/042
See application file for complete search history.

(56) References Cited

U.S. PATENT DOCUMENTS 6,388,385 B1 5/2002 McGinn et al.

FOREIGN PATENT DOCUMENTS

JP H09143704 A 6/1997
WO 2007109666 A2 9/2007

OTHER PUBLICATIONS

Growth of microscopic cones on titanium cathodes of sputter-ion pumps driven by sorption of large argon quantities. Tommaso Porcelli, Fabrizio Silviero and Gero A. Bongiorno, Paolo Michelato, Carlo Pagani. J. Vac Sci Technol. A, vol. 33, 05E109 (2015); doi: 10.1116/1.4922575. Sep./Oct. 2015. 9 pages.
Agilent 06 Ion Pumps. Agilent Technologies. Dec. 8, 2014. 53 pages.
British Search Report dated May 31, 2018 and Examination Report dated Jun. 1, 2018 for corresponding British Application No. GB1720228.4.
Peirson, Comparison of the ASTM Comparative Chart Method and the Mean Line Intercept Method in Determining the Effect of Solidification Rate on the Yield Strength of AA5182, Grand Valley StateUniversity, [online], available from: http://www2.gvsu.edu/peirsonb/solidification_yield_strength.pdf, [accessed May 22, 2018], 15 pages.

*Primary Examiner* — Joseph L Williams
(74) *Attorney, Agent, or Firm* — Theodore M. Magee; Westman, Champlin & Koehler, P.A.

(57) ABSTRACT

A method includes assessing a plurality of Titanium plates to determine a grain size for each plate and removing all Titanium plates with an average grain size that is larger than a threshold size from the plurality of Titanium plates. One of the Titanium plates remaining in the plurality of Titanium plates after the removing step is then used to form a cathode for an ion pump.

18 Claims, 10 Drawing Sheets

Spectrum 1
Cnts
15.0K
10.0K
5.0K
Ti
Ta
Ta
Ta

ION PUMP NOBLE GAS STABILITY USING SMALL GRAIN SIZED CATHODE MATERIAL

BACKGROUND

Ultra-high vacuum is a vacuum regime characterized by pressures lower than $10^{-7}$ pascal ($10^{-9}$ approximately $10^{-9}$ tor). Ion pumps are used in some settings to establish an ultra-high vacuum. In an ion pump, an array of cylindrical anode tubes are arranged between two cathode plates such that the openings of each tube faces one of the cathode plates. An electrical potential is applied between the anode and the cathode. At the same time, magnets on opposite sides of the cathode plates generate a magnetic field that is aligned with the axes of the anode cylinders.

The ion pomp operates by trapping electrons within the cylindrical anodes through a combination of the electrical potential and the magnetic field. When a gas molecule drifts into one of the anodes, the trapped electrons strike the molecule causing the molecule to ionize. The resulting positively charged ion is accelerated by the electrical potential between the anode and the cathode toward one of the cathode plates leaving the stripped electron(s) in the cylindrical anode to be used for further ionization of other gas molecules. The positively charged ion is eventually trapped by the cathode and is thereby removed from the evacuated space. Typically, the positively charged ion is trapped through a sputtering event in which the positively charged ion causes material from the cathode to be sputtered into the vacuum chamber of the pump. This sputtered material coats surfaces within the pump and acts to trap additional particles moving within the pump.

The discussion above is merely provided for general background information and is not intended to be used as an aid in determining the scope of the claimed subject matter. The claimed subject matter is not limited to implementations that solve any or all disadvantages noted in the background.

SUMMARY

A method includes assessing a plurality of Titanium plates to determine a grain size for each plate and removing all Titanium plates with an average grain size that is larger than a threshold size from the plurality of Titanium plates. One of the Titanium plates remaining in the plurality of Titanium plates after the removing step is then used to form a cathode for an ion pump.

In accordance with a further embodiment, a method includes requiring that a cathode plate have au average grain size that is smaller than a threshold size and constructing an ion pump from the cathode plate.

In accordance with a still further embodiment, a method includes setting a maximum average grain size for a cathode plate in an ion pump and building the ion pump using a cathode plate that has an average grain size that is less than the maximum gram size.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION OF ILLUSTRATIVE EMBODIMENTS

Figure 1:
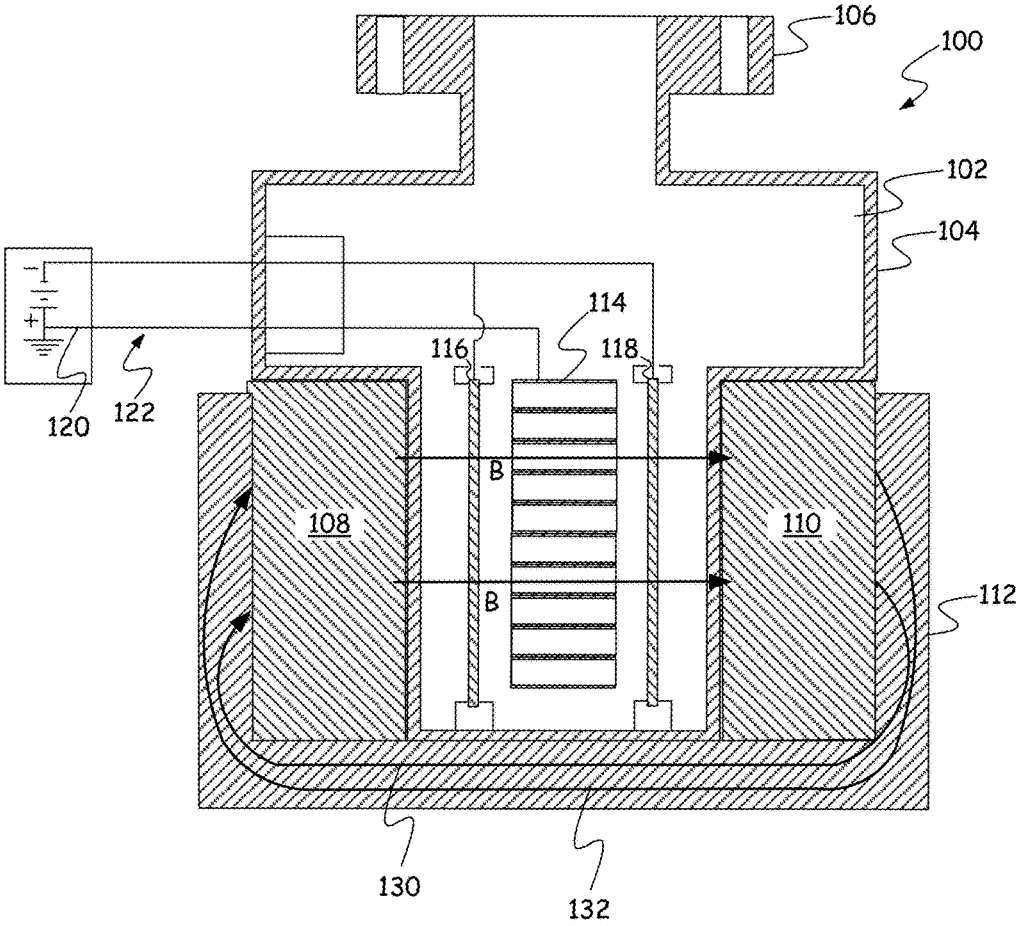
FIG. 1 (Prior Art)
FIG. 1 is a sectional view of an ion pump of the prior art.

FIG. 1 provides a sectional view of a prior art ion pump 100. Ion pump 100 includes a vacuum chamber 102 defined by a chamber wall 104 that is welded to a connection flange 106 for connection to a system to be evacuated. Two ferrite magnets 108 and 110 located external to chamber all 104 and are mounted on opposing sides of ion pump 100. A magnetic flux guide 112 is positioned on the outside of each of ferrite magnets 108 and 110 and extends below ion pump 100 to guide magnetic flux between the exteriors of each of the ferrite magnets 108 and 110 as shown by arrows 130 and 132. Ferrite magnets 108 and 110 produce a magnetic field B that passes through vacuum chamber 102.

Within vacuum chamber 102, an array cylindrical anodes 114 is positioned between two cathode plates 116 and 118 such that the openings of each anode cylinder face the cathode plates.

The cylindrical anodes 114 and chamber wall 104 are maintained at ground potential while cathode plates 116 and 118 are maintained at a negative potential by an external power supply 120 that is connected to ion pump 100 by a power cable 122. In accordance with some embodiments, the potential difference between cylindrical anode 114 and cathode plates 116 and 118 is 7 kV.

In operation, flange 106 is connected to a flange of a system to be evacuated. Once the flange is connected, particles within the system to be evacuated travel into vacuum chamber 102 and eventually move within the interior of one of the cylindrical anodes 114. The combination of the magnetic field B and the electrical potential between anodes 114 and cathode plates 116 and 118 cause electrons to be trapped within each of the cylindrical anodes 114. Although trapped within the cylindrical anodes 114, the electrons are in motion such that as particles enter a cylindrical anode 114, they are struck by the trapped elections causing the panicles to ionize. The resulting positively charged ions are accelerated by the potential difference between anode 114 and the cathode plates 116 and 118 causing the positively charged ions to move from the interior of cylindrical anodes 114 toward one of the cathode plates 116 and 118.

The ions strike the cathode plates 116/118 causing material from the cathode plates to sputter outwardly away from cathode plates 116/118 and to cause the ions to become embedded in cathode plates 116/118. This removes the ions from the pump thereby reducing the pressure in the ion pump.

In standard ion pumps, cathode plates 116 and 118 are both made of Titanium. However, it was found that having both cathode plates made a Titanium resulted in pump instability when pumping a large amount of Noble gases such as Argon. During pump instability, previously trapped Noble gases are re-released from the cathode plates into the pump at a rate that is faster than the ion pump can remove them. The result is a sudden rise in pump pressure by as much as 100,000%.

To address this problem, the prior art created Noble Diode ion pumps (DI pumps) where one of the cathode plates is constructed of Tantalum and the other is constructed of Titanium. While this reduced the occurrence of pump instability, some DI pumps continued to show pump instability.

Figure 2:
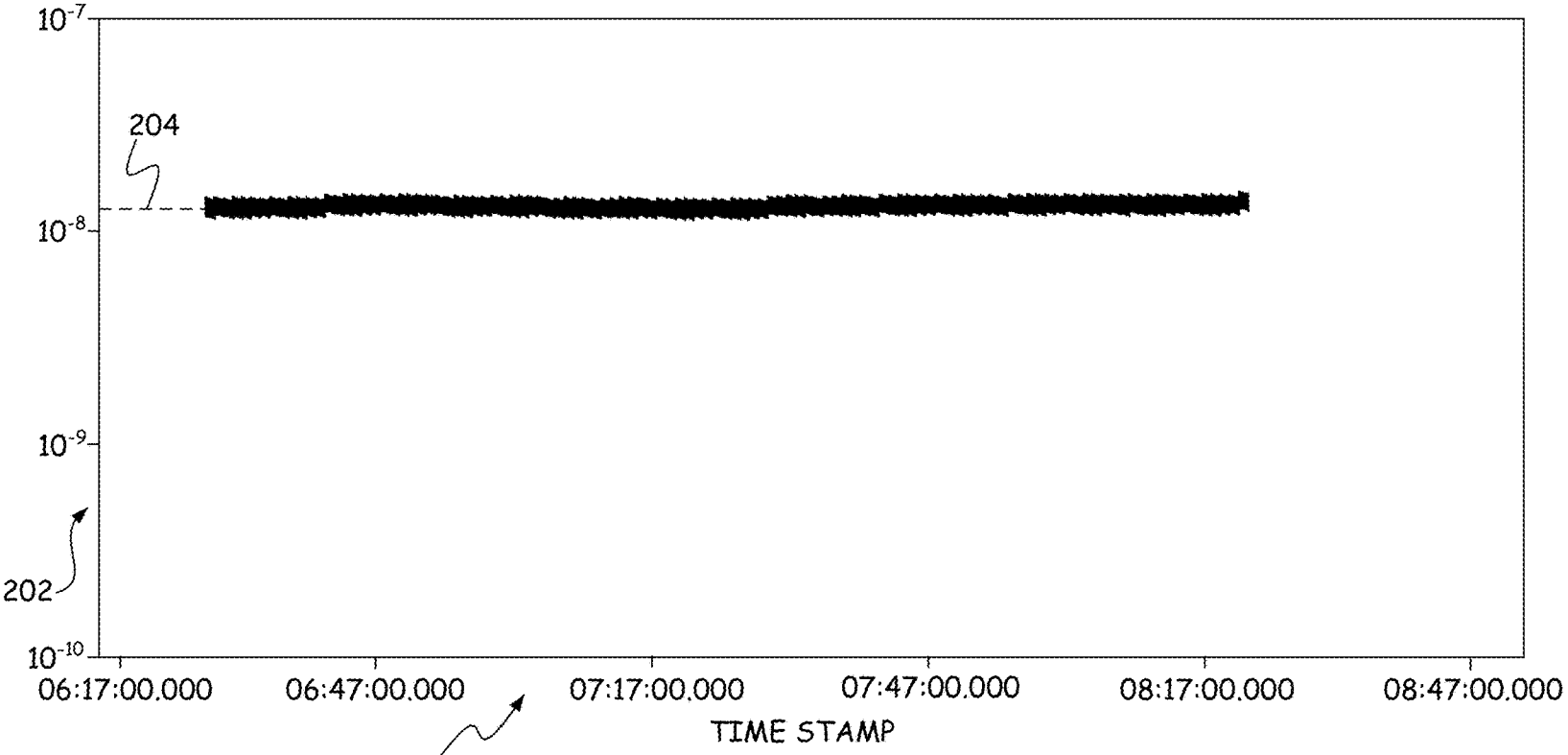
FIG. 2 is a graph of pressure in an ion pump in the presence of a constant source of Argon when trapped Argon is not being rereleased from the cathode plates.
Figure 3:
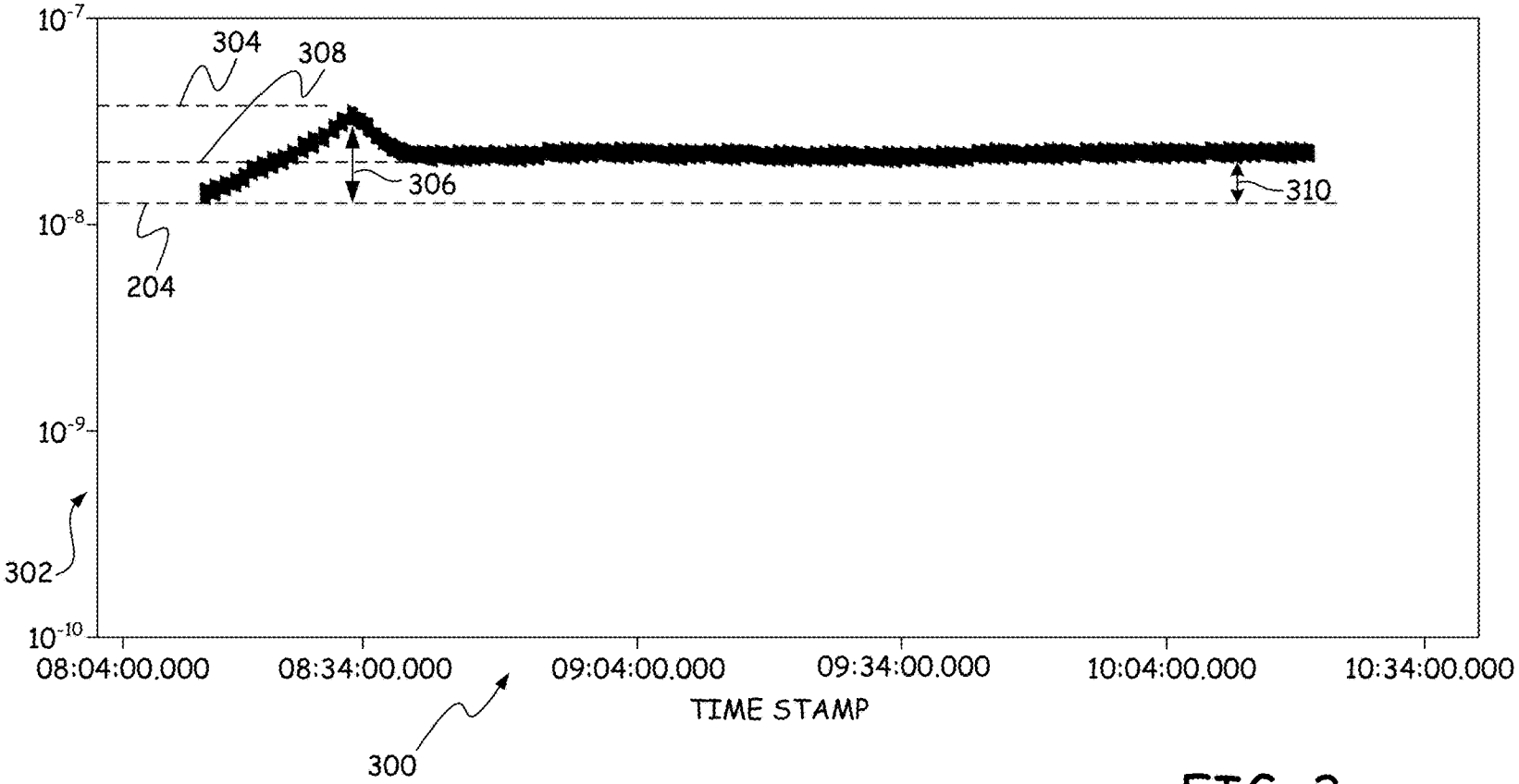
FIG. 3 is a graph of pressure in an ion pump in the presence of a constant source of Argon when trapped Argon is being released from the cathode plates but the ion pump remains stable.
Figure 4:
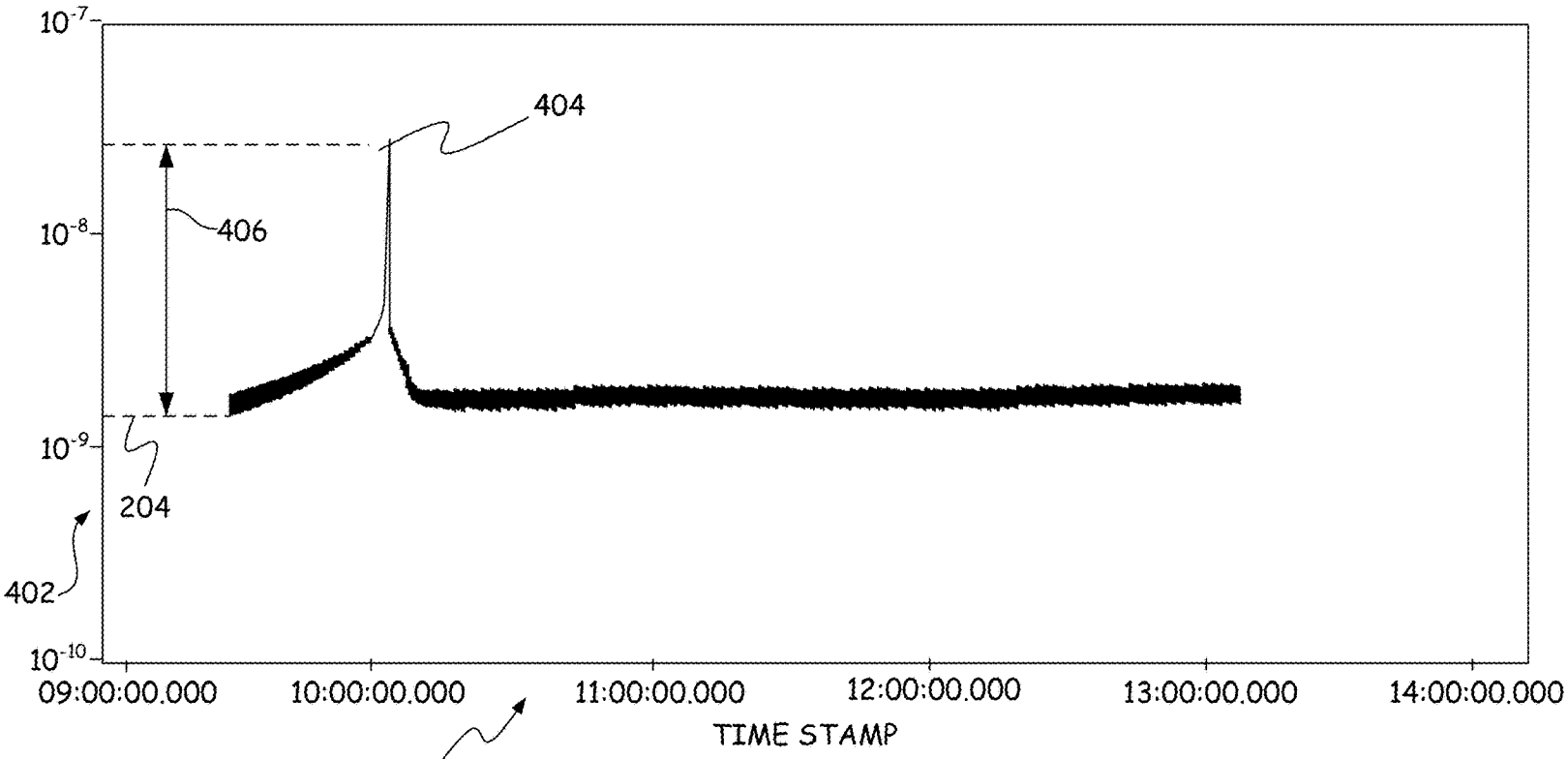
FIG. 4 is a graph of pressure in an ion pump in the presence of a constant source of Argon when trapped Argon is being rereleased from the cathode plates and the ion pump becomes unstable.

FIGS. 2, 3, and 4 show graphs of pump pressure for ion pumps of the prior art under conditions when the pump does not experience a re-release of Argon (FIG. 2), the pump experiences a re-release of Argon but the release is small and stable (FIG. 3), and when the pump experiences a re-release and enters a period of instability under which the pressure rises dramatically (FIG. 4). In each of FIGS. 2, 3, and 4, time is shown along a respective horizontal axis 200, 300, and 400 and pressure is shown along a logarithmic scale on respective vertical axis 202, 302, and 402. As shown in FIG. 2, when the ion pump is exposed to a constant input stream of Argon and does not experience a re-release of Argon, the pump pressure is maintained at a constant level 204. As shown in FIG. 3, when an ion pump experiences a re-release of Argon, the pump pressure begins at the stable level 204 and increases to a peak 304 with the difference between pressure 304 and 204 being designated as peak drift 306. During the increase of pressure, Argon is being re-released from the cathode plates at a rate that is faster than the cathode plates can re-capture the Argon. After reaching peak 304, the release rate becomes less than the re-capture rate and the pressure begins to drop again until reaching a stable pressure 308. Note that stable pressure 308 is different from stable pressure 204 of FIG. 2 with the difference between the two stable pressures being referred to as drift final 310. Thus, even after the peak pressure, the cathode plates continue to re-release Argon into the ion pump thereby preventing the ion pump from reaching the lower pressure level 204 obtainable when the cathode plates are not re-releasing Argon.

As shown in FIG. 4 at times, the re-release of Argon can rise exponentially resulting in a peak pressure 404 that has a peak drift 406 that is more than an order of magnitude larger than stable pressure 204. This rapid pressure increase causes the ultrahigh vacuum environment to be lost thereby causing experiments or manufacturing processes being performed in the ultrahigh vacuum to fail.

In the prior art, Noble gas instability appeared to be a random event. Some DI pumps experienced such instability while other DI pumps did not and there was no way to predict which DI pumps were more likely to become unstable. As a result, there was no way to reduce the occurrence of pump instability through the manufacturing process.

Embodiments of the present invention provide a method for reducing Noble gas instability by requiring that Titanium cathode plates have a maximum grain size in order to be used in the construction of an ion pump.

In metals, atoms are linked together in crystalline structures. Typically, multiple crystalline structures are present in a metal sample and have different orientations from each other. Each distinct crystalline structure is referred to as a grain and the locations where two different crystalline structures meet are referred to as grain boundaries. The distance between two grain boundaries along a line across a grain is referred to as the grain size. The grain size in a metal sample varies considerably from grain to grain. Nonetheless, some metal samples have larger average grain sizes than other metal samples. One technique for evaluating the grain size of a sample, known as ASTM test method E112, involves measuring the number of grain boundaries along a line. This number is then applied to a function that compensates for the magnification under which the measurement was taken and the length of the line that was used. The value computed by the function as typically an integer referred to as a grain number. Since the grain number is based on the number of grain boundaries that are encountered, samples with smaller average grain sizes have larger grain numbers since there will be more grain boundaries in a fixed length of as sample with smaller grain sizes than in a sample with larger grain sizes. Thus, a sample with a grain number of 2 has a larger grain size than a sample with a grain number of 10. Other methods of determining grain size determine the number of grain boundaries in a unit area at a particular magnification. In the embodiments described below, the ASTM standard for grain number is used however any standard may be used.

Figure 5:
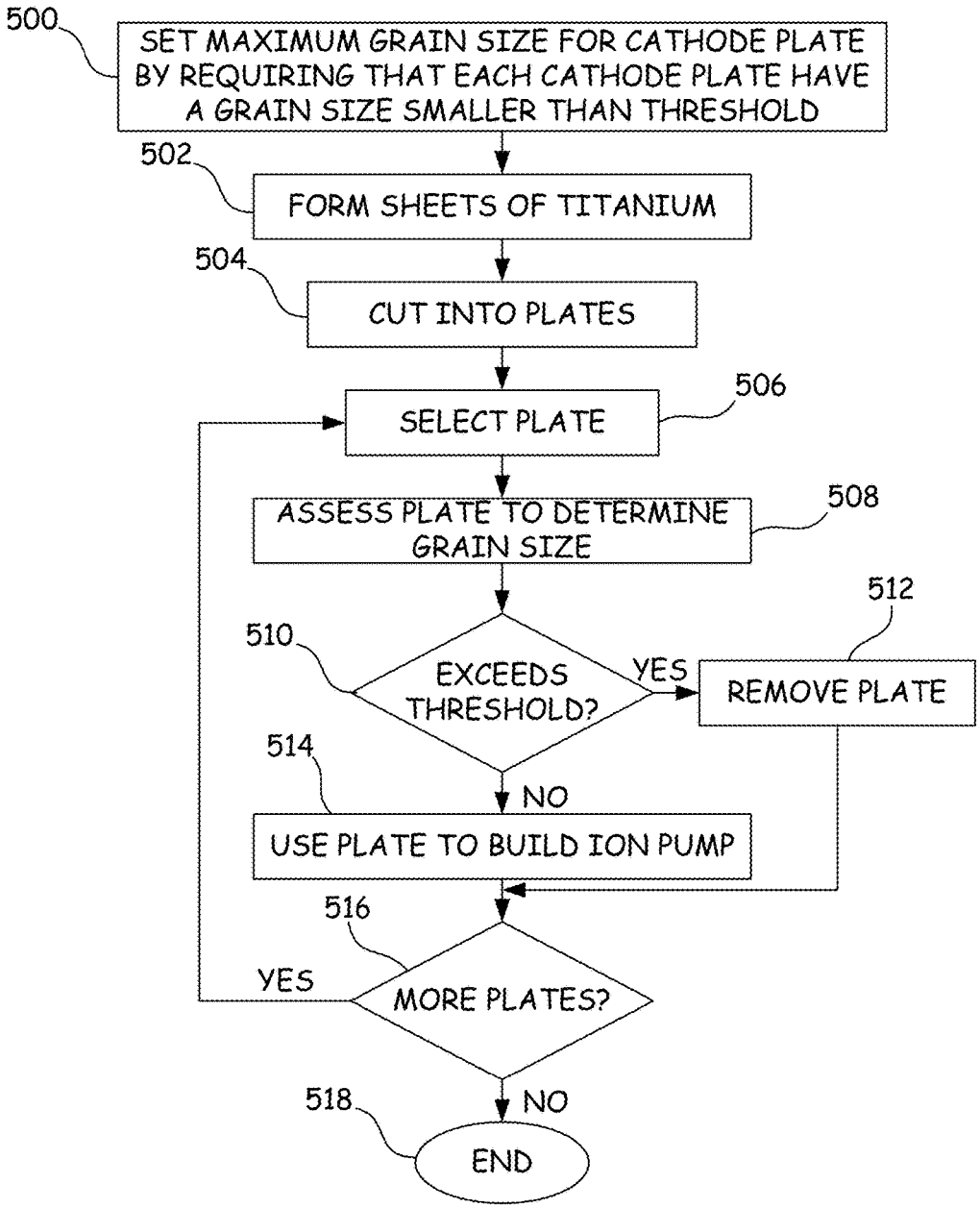
FIG. 5 is a method of manufacturing ion pumps to reduce the likelihood of Argon instability.

FIG. 5 provides a method for forming an ion pump in accordance with one embodiment. At step 500 of FIG. 5, a maximum grain size is set for a cathode plate by requiring each cathode plate to have an average grain size smaller than a threshold. At step 502, a sheet of Titanium is formed and at step 504 the sheet is cut into plates. At step 506, a plate is selected and at step 508, the plate is assessed to determine its grain size. For example, ASTM method E112 can be used to determine a grain number representative of the average grain size. Alternative methods can be used to form the grain number where the alternative methods produce different grain numbers than the ASTM method for the same set of average grain sizes. At step 510, the determined average grain size is compared to the threshold. This comparison can involve comparing the grain number determined at step 508 to a threshold grain number provided at step 500. When using the grain number instead of the grain size, the comparison performed in step 510 determines whether the measured grain number of the plate is smaller than a minimum threshold grain number provided in step 500.

If the average grain size exceeds the maximum grain size threshold (or equally if the grain number is less than the minimum grain number threshold) the plate is removed at step 512 and is not used to build an ion pump. If at step 510, the average grain size does not exceed the maximum gram size threshold (or equally the grain number is not less than the minimum grain number threshold) the plate is used to build an ion pump at step 514.

After step 512 or step 514, the process determines if there are more plates to be evaluated at step 516. If there are more plates to be evaluated, the process returns to step 506 to select the next plate. Steps 508-516 are then repeated for the next plate. When all the plates have been processed, the method of FIG. 5 ends at step 518.

Although the embodiment above tests every plate for average grain size, in other embodiments, a single sample of a sheet of Titanium is tested and if the average grant size of the sample exceeds the threshold, the entire sheet of Titanium is removed so that cathode plates are not formed from the sheet. If the average grain size of the sample does not exceed the threshold, the sheet is cut into plates that are then used to build ion pumps.

In accordance with some embodiments, in addition to requiring that the average grain size be less than a threshold grain size, the Titanium plate is required to be of a specific ASTM grade, where the grade indicates the types and amounts of other elements present in the Titanium plate but does not by itself specify a grain size. In accordance with one particular embodiment, the cathode plate is required to be formed of Grade 2 Titanium with a maximum average grain size described by ASTM grain number 9.

In accordance with one embodiment, the threshold grain size is set such that each ion pump is built with Titanium plates containing average grain sizes with ASTM grain numbers that are no smaller than 9. By using Titanium plates with ASTM grain numbers of 9 or greater, the present inventors have discovered that the occurrence of Noble gas instability and in particular Argon instability can be reduced and in some cases completely removed from produced ion pumps. Thus, the likelihood of Noble gas and in particular Argon gas instability is reduced through the method of FIG. 5.

Figure 6:
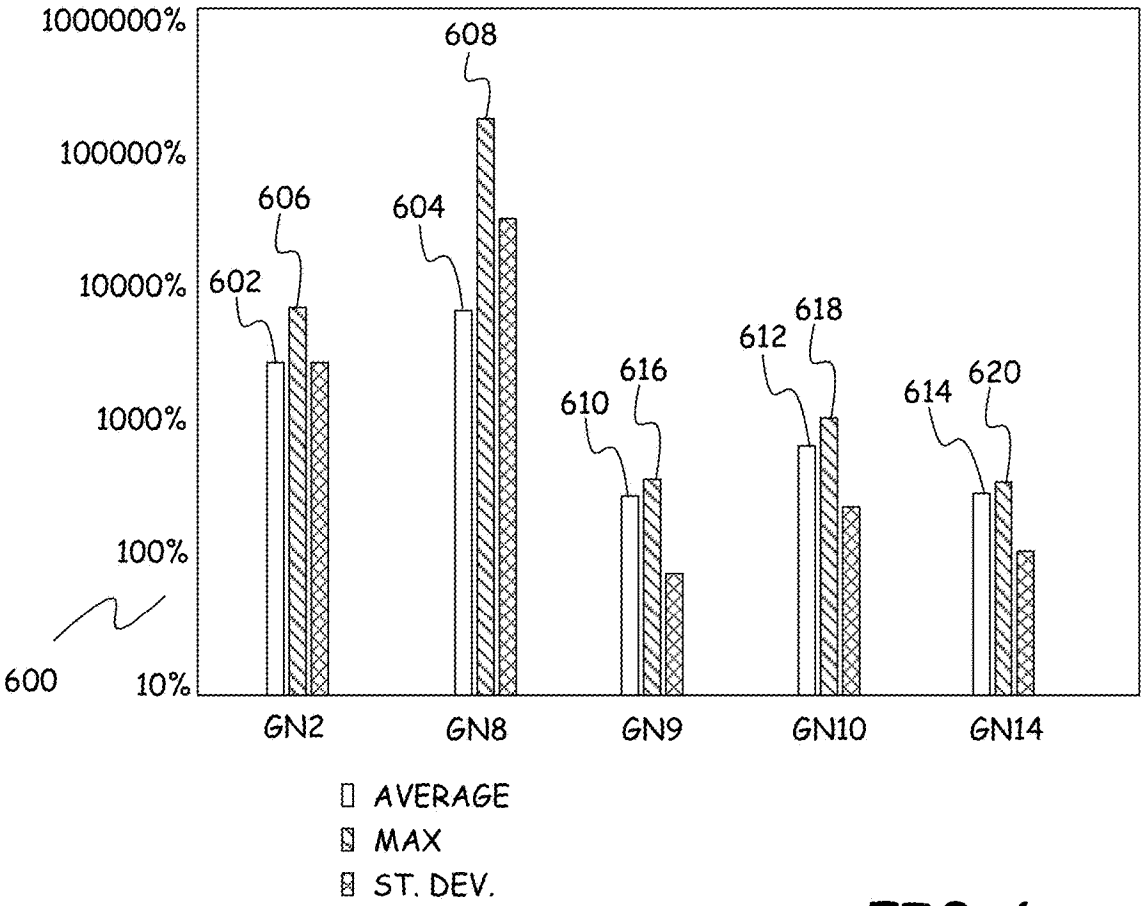
FIG. 6 is a chart of average peak drift, maximum peak drift, and standard deviation of peak drift for ion pumps constructed of Titanium cathode plates of various grain sizes.

To evaluate the performance of ion pumps constructed with Titanium plates with grain numbers of 9 or greater, the present inventors constructed ion pumps with Titanium plates of grain numbers 2, 8, 9, 10, and 14. The peak drift for each ion pump was then measured to determine a maximum peak drift, an average peak drift, and a standard deviation in the peak drift. FIG. 6 provides a chart showing the average peak drift, the maximum peak drift, and the standard deviation in peak drift for each grain number. Vertical axis 600 shows the peak drift and standard deviation as a percentage of the peak drift and standard deviation, respectively of a stable ion pump when Argon is not rereleased. In FIG. 6, vertical axis 600 is on a logarithmic scale. The average peak drifts 602 and 604, and the maximum peak drifts 606 and 608 for samples with grain numbers 2 and 8 are significantly larger than the average peak drifts 610, 612, and 614, and the maximum peak drifts 616, 618, and 620 for samples with grain numbers 9, 10, and 14, respectively. In particular, the average and maximum peak drifts of the samples with grain numbers 2 and 8 are shown to be orders of magnitudes larger than those for the samples of grain numbers 9, 10 and 14.

Figure 7:
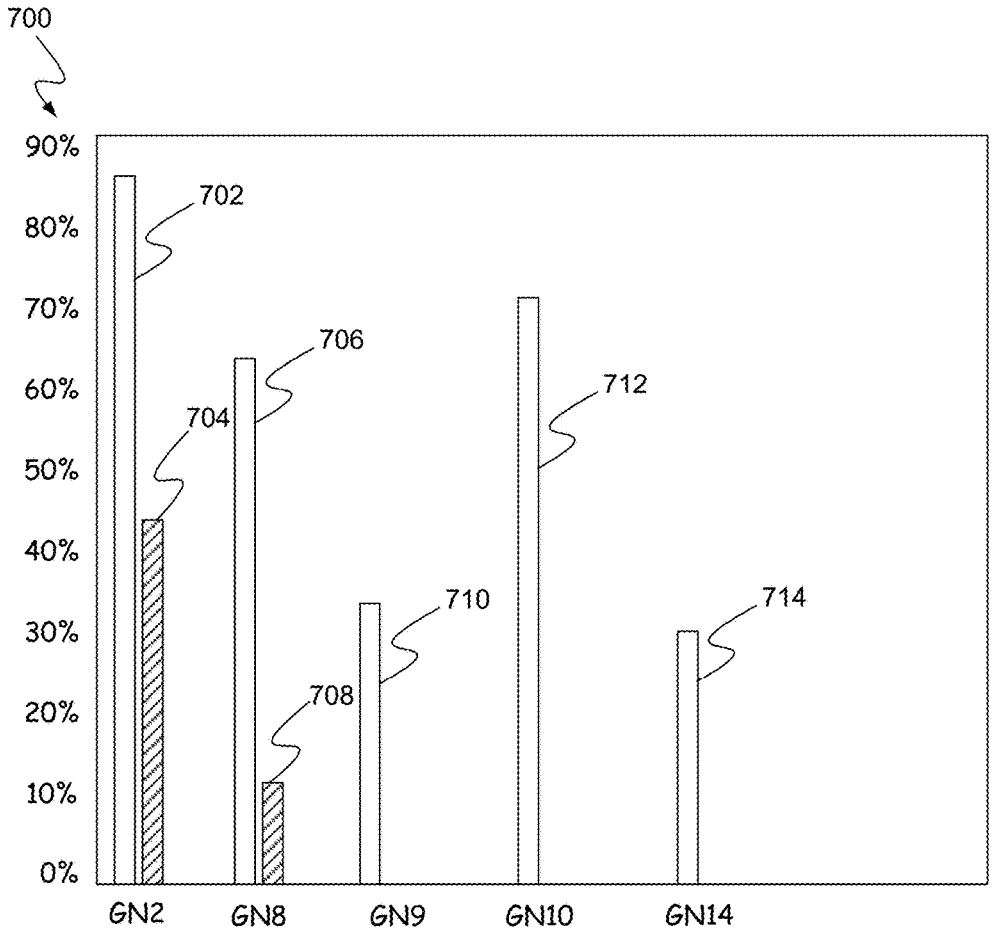
FIG. 7 is a chart of peak drift frequency and instability frequency for ion pumps constructed of Titanium cathode plates of various grain sizes.

FIG. 7 provides a graph of the frequency of peak drifts and the frequency of Argon instability for samples with grain numbers 2, 8, 9, 10, and 14. Frequency is shown on vertical axis 700 as a percentage of the number of tests performed. The frequency of drift peaks are shown by bars 702, 706, 710, 712, and 714 for samples with grain numbers 2, 8, 9, 10, and 14, respectively. Bars 704 and 708 show the frequency of Argon instability for samples with grain numbers 2 and 8, respectively. As shown in FIG. 7, the samples with the grain numbers 9, 10, and 14 did not incur any Argon instability while the samples with the grain numbers 2 and 8 incurred frequent instability with the grain number 2 samples incurring Argon instability over 40% of the time.

Figure 8:
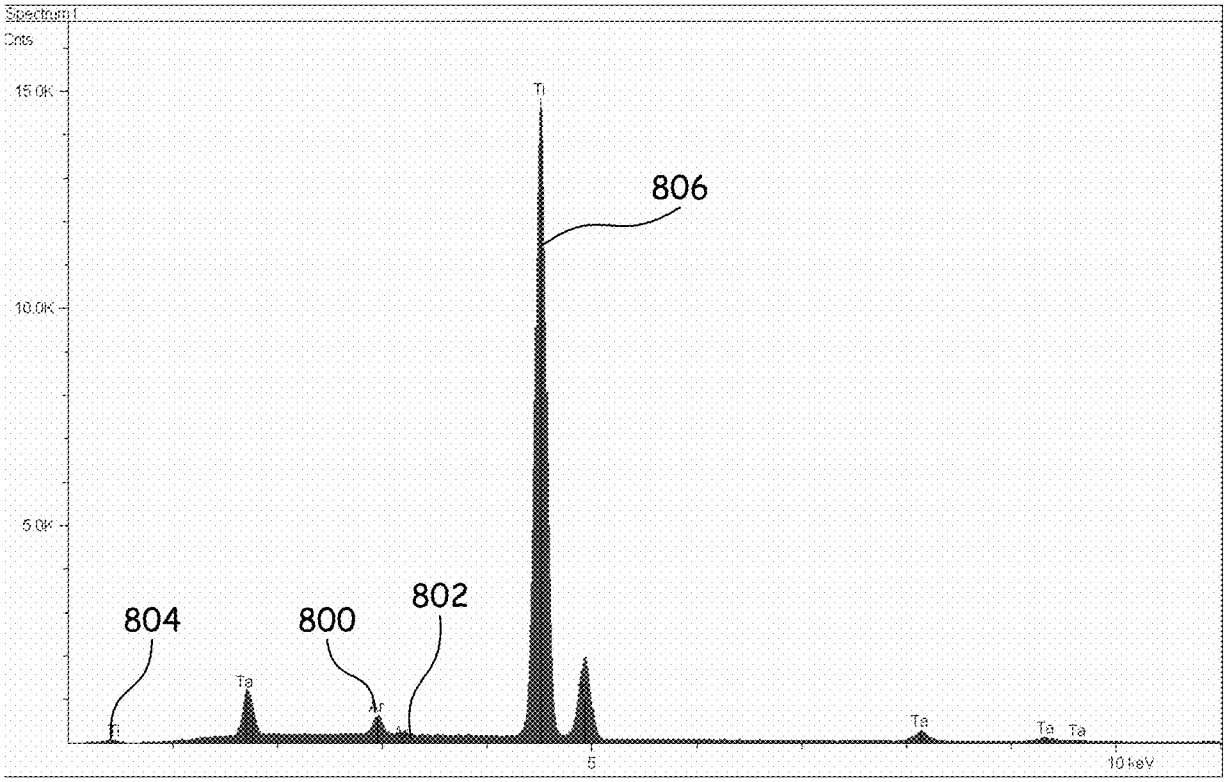
FIG. 8 provides a graph of Microbulk X-ray Fluorescence Spectrometer results for a vertical structure on a surface at a cathode plate.

The root cause of the instability based on grain size appears to be related to the construction of vertical structures on the surface of the Titanium during sputtering. These structures encapsulate Argon as shown in FIG. 8, which provides a graph of Microbulk X-ray Fluorescence Spectrometer results for one such structure. In. FIG. 8, peaks 800 and 802 are associated with Argon being present in the vertical structure and peaks 804 and 806 are associated with Titanium being present in the vertical structure. It is thought that the encapsulated Argon found in the vertical strictures is released when the structures collapse or fracture. However, the root cause of the instability is irrelevant to the various embodiments.

Figure 9:
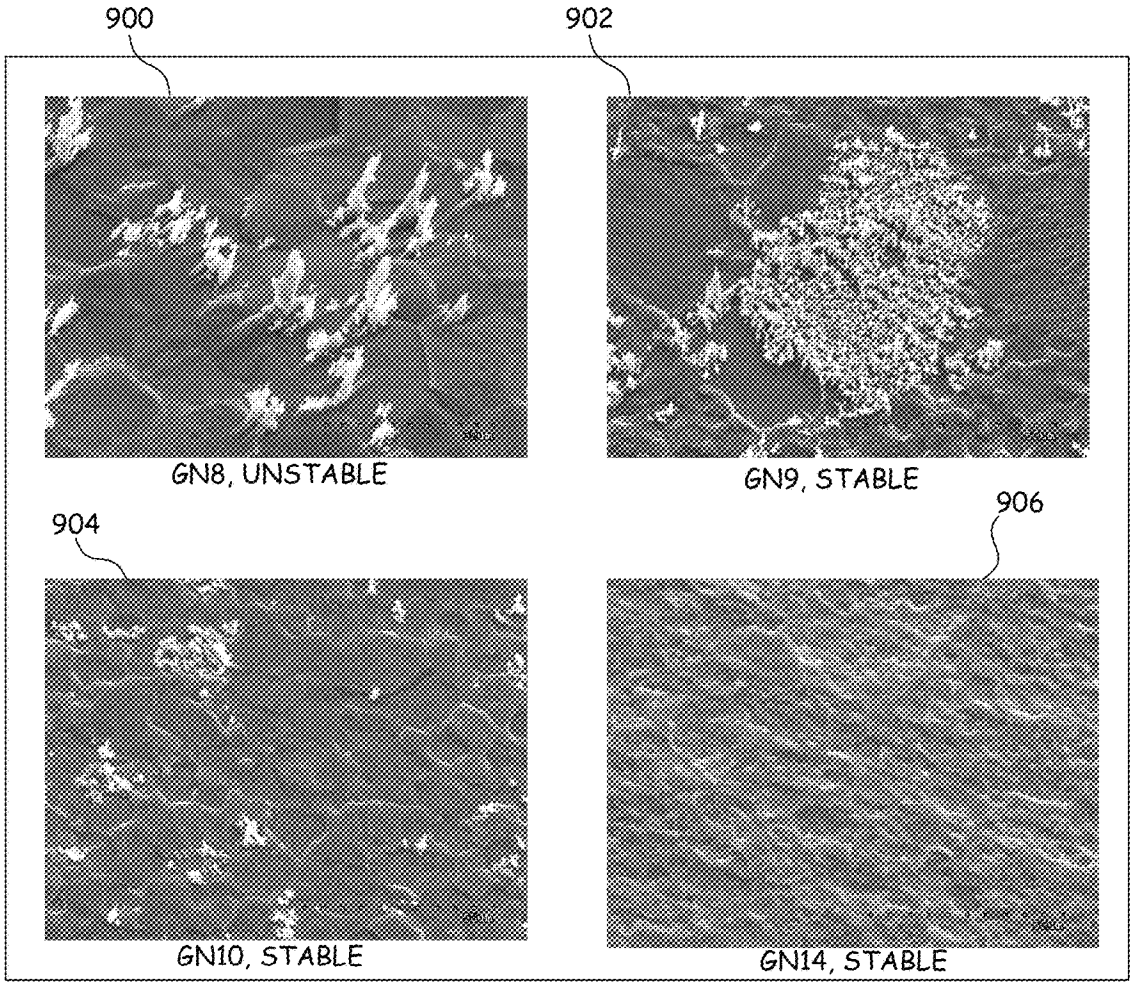
FIG. 9 contains magnified images of surfaces of Titanium cathode plates of various grain sizes.
Figure 10:
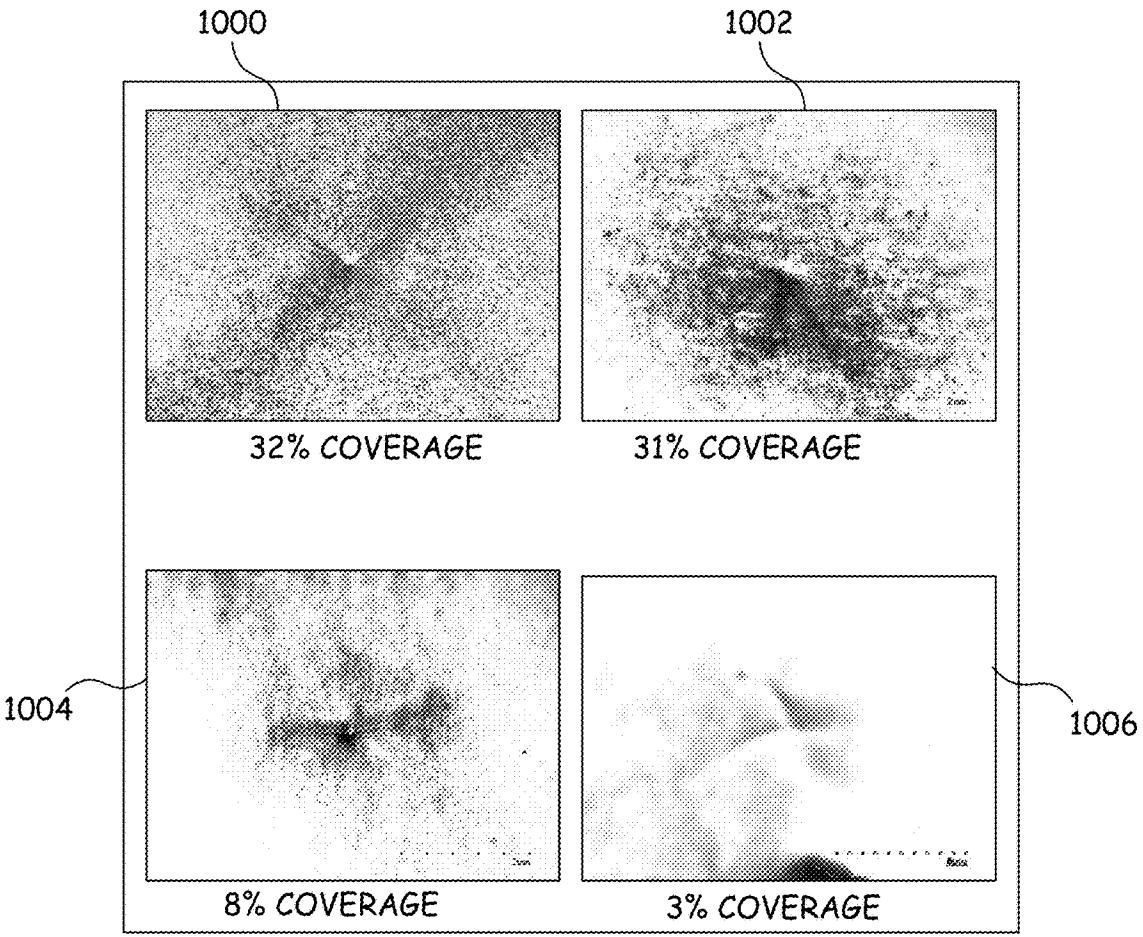
FIG. 10 contains binary images showing the locations of vertical structures formed on the surfaces of Titanium cathode plates of various grain sizes.

FIG. 9 provides magnified images 900, 902, 904, and 906 for Titanium cathode plates with grain numbers of 8, 9, 10, and 14, respectively. In the magnified images, the vertical structures containing the trapped Argon appear as light spots OD top of the relatively smooth surface of the cathode plate. As can be seen, comparing grain number 8 scan 900 to grain number 9 scan 902, the height of the vertical structures in the grain number 8 sample appear to be higher than the height of the vertical structures in the grain number 9 sample. Further, the percentage of the surface covered with such vertical structures appears to get smaller with larger grain numbers (smaller grain sizes). This can be seen more clearly in FIG. 10, which provides images 1000 1002, 1004, and 1006 of samples with grain numbers 8, 9, 10, and 14. The images in FIG. 10 are at a lower magnification than FIG. 10 and the vertical structures are shown as dark areas while the flat surfaces of the plate are shown in white. As shown, 32% of the grain number 8 surface 1000 is covered with vertical structures, 31% of the grain number 9 surface 1002 is covered with vertical structures, 8% of the gram number 10 surface 1004 is covered with vertical structures, and 3% of the grain number 14 surface 1006 is covered with vertical structures.

Thus, it appears the formation and perhaps destruction of these vertical surfaces contributes to Argon instability in that by using smaller grain sizes, the present in reduces either the size or frequency of these structures and thereby reduces the occurrence of Argon instability.

Although the discussion above refers to Argon and Argon instability, the present invention may be used with any Noble gases to reduce noble gas instability.

Although elements may have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms for implementing the claims.

Although the present invention has been described with reference to preferred embodiments, workers skilled in the art will recognize that changes may be made in form and detail without departing from the spirit and scope of the invention.

What is claimed is:

1. A method comprising:

assessing a plurality of titanium plates to determine a grain size for each plate;

removing all titanium plates with an average grain size that is larger than a threshold size from the plurality of titanium plates;

using one of the titanium plates remaining in the plurality of titanium plates after the removing step to form a cathode for an ion pump.

2. The method of claim 1 wherein the threshold grain size has an ASTM grain number of 9.

3. The method of claim 1 wherein the plurality of titanium plates comprises titanium plates of a single grade.

4. The method of claim 1 wherein removing the titanium plates with a grain size that is larger than the threshold size decreases a likelihood that an ion pump containing one of the titanium plates remaining in the plurality of titanium plates will incur noble gas instability.

5. The method of claim 4 wherein removing the titanium plates with a grain size that is larger than the threshold size decreases a likelihood that an ion pump containing one of the titanium plates remaining in the plurality of titanium plates will incur Argon instability.

6. A method comprising:

requiring that a cathode plate have an average grain size that is smaller than a threshold size; and constructing an ion pump from the cathode plate.

7. The method of claim 6 wherein cathode plates with an average grain size smaller than the threshold size have less frequent noble gas instability than cathode plates with average grain sizes that are larger than the threshold size.

8. The method of claim 7 wherein the threshold grain size has an ASTM grain number of 9.

9. The method of claim 6 wherein requiring that a cathode plate have an average grain size smaller than a threshold size comprises requiring that material for the cathode plate be analyzed to determine the average grain size of the material.

10. The method of claim 6 wherein the cathode is made of titanium.

11. The method of claim 10 wherein the cathode is made of a single grade of titanium.

12. A method comprising:

setting a maximum average grain size for a cathode plate in an ion pump; and building the ion pump using a cathode plate that has an average grain size that is less than or equal to the maximum grain size.

13. The method of claim 12 wherein the cathode plate contains titanium.

14. The method of claim 12 wherein setting the maximum average grain size comprises setting the maximum average grain size to reduce noble gas instability in the ion pump.

15. The method of claim 14 setting the maximum average grain size to reduce noble gas instability in the ion pump comprises setting the maximum average grain size to reduce Argon instability in the ion pump.

16. The method of claim 14 wherein the maximum average grain size has an ASTM grain number of 9.

17. The method of claim 16 wherein the cathode plate is made of Grade 2 titanium.

18. The method of claim 12 wherein the cathode plate is made of Grade 5 titanium.

* * * * *